US010010919B2

(12) United States Patent
Bäckman

(10) Patent No.: US 10,010,919 B2
(45) Date of Patent: Jul. 3, 2018

(54) METHOD AND ARRANGEMENT FOR ALIGNING A VEHICLE

(75) Inventor: Jonas Bäckman, Danderyd (SE)

(73) Assignee: Car-O-Liner AB, Kungsör (SE)

( * ) Notice: Subject to any disclaimer, the term of this patent is extended or adjusted under 35 U.S.C. 154(b) by 1112 days.

(21) Appl. No.: 13/139,685

(22) PCT Filed: Dec. 14, 2009

(86) PCT No.: PCT/SE2009/051417
§ 371 (c)(1),
(2), (4) Date: Aug. 2, 2011

(87) PCT Pub. No.: WO2010/071568
PCT Pub. Date: Jun. 24, 2010

(65) Prior Publication Data

US 2011/0277523 A1 Nov. 17, 2011

(30) Foreign Application Priority Data

Dec. 15, 2008 (SE) ..... 0850138

(51) Int. Cl.
*B21D 1/14* (2006.01)
*B21D 7/14* (2006.01)
(Continued)

(52) U.S. Cl.
CPC ..... *B21D 1/14* (2013.01); *B21D 1/12* (2013.01); *B21D 7/14* (2013.01); *B21D 3/16* (2013.01); *Y10S 72/705* (2013.01)

(58) Field of Classification Search
CPC ... B21D 1/00; B21D 1/06; B21D 1/10; B21D 1/14; B21D 1/145; B21D 1/12;
(Continued)

(56) References Cited

U.S. PATENT DOCUMENTS 4,055,061 A * 10/1977 Bayorgeon ..... B21D 1/14 72/705
4,811,250 A * 3/1989 Steber ..... G01S 5/30 72/31.02
(Continued)

FOREIGN PATENT DOCUMENTS

CN 201023104 2/2008
DE 4034770 A1 5/1992
(Continued)

OTHER PUBLICATIONS

International Preliminary Report on Patentability for International Application No. PCT/SE2009/051421 dated Jun. 21, 2011.
(Continued)

*Primary Examiner* — R. K. Arundale
*Assistant Examiner* — Pradeep C Battula
(74) *Attorney, Agent, or Firm* — Myers Bigel, P.A.

(57) ABSTRACT

A method for of aligning a vehicle includes the steps of: supporting a first portion (19A, 19B) of the vehicle, deforming the vehicle by applying a force to a second portion (5) of the vehicle, positioning at least one motion sensing measuring unit (9A, 9B) including at least one accelerometer on the supported first portion (19A, 19B) of the vehicle before the deforming step, and tracking any movements of the supported first portion (19A, 19B) of the vehicle during the deformation by means of the motion sensing measuring unit (9A, 9B). An arrangement for aligning a vehicle is also provided.

15 Claims, 3 Drawing Sheets

(51) Int. Cl.
*B21D 1/12* (2006.01)
*B21D 3/16* (2006.01)

(58) Field of Classification Search
CPC ... B21D 3/00; B21D 3/14; B21D 3/16; B21D 7/14; Y10S 72/705; B23Q 17/003
USPC ..... 72/18.1, 31.04, 31.01, 21.4, 28.1, 31.02, 72/31.03, 31.1, 31.11
See application file for complete search history.

(56) References Cited

U.S. PATENT DOCUMENTS

| | | | | |
|---|---|---|---|---|
| 6,098,445 | A * | 8/2000 | Meis | B21D 1/12 72/295 |
| 6,115,927 | A | 9/2000 | Hendrix | |
| 6,980,880 | B1 * | 12/2005 | Ramsey | 72/31.04 |
| 7,100,289 | B1 * | 9/2006 | Strege et al. | 33/203 |
| 7,181,852 | B2 | 2/2007 | Bryan | |
| 7,324,916 | B1 | 1/2008 | Phillips | |
| 7,376,492 | B2 * | 5/2008 | Srack | G01B 5/0025 33/288 |
| 7,600,408 | B2 * | 10/2009 | Potter | B21D 1/12 72/20.1 |
| 2004/0194327 | A1 | 10/2004 | Bryan | |
| 2006/0283027 | A1 | 12/2006 | Bryan | |

FOREIGN PATENT DOCUMENTS

| | | |
|---|---|---|
| DE | 102006061465 | 6/2008 |
| RU | 2162203 C1 | 1/2001 |
| RU | 2314172 C2 | 1/2008 |
| SU | 1706742 A1 | 1/1992 |
| SU | 1808447 A1 | 4/1993 |
| SU | 1827541 A1 | 7/1993 |

OTHER PUBLICATIONS

International Search Report in PCT Application No. PCT/SE2009/051417 dated Mar. 17, 2010, 4 pages.
Search Report for Chinese Application No: 200980150614.5; dated Sep. 4, 2012.
Russian Office Action Corresponding to Russian Application No. 2011126655/02(039527); dated Dec. 6, 2013; 4 Pages.
Office Action for corresponding Indian Patent Application No. 5144/DELNP/2011 dated Nov. 22, 2017, 4 pages.

* cited by examiner

METHOD AND ARRANGEMENT FOR ALIGNING A VEHICLE

RELATED APPLICATIONS

The present application is a 35 U.S.C. § 371 national phase application of PCT International Application No. PCT/SE2009/051417, filed Dec. 14, 2009, which claims priority from Swedish Patent Application No. 0850138-9, filed Dec. 15, 2008, the disclosures of which are hereby incorporated herein by reference in their entireties. The above PCT International Application was published in the English language and has International Publication No. WO 2010/071568 A1.

TECHNICAL FIELD

The invention relates to aligning deformed vehicles, such as cars and trucks and similar motor driven land vehicles.

BACKGROUND ART

Methods have been provided for measuring vehicles, which can determine if a vehicle is deformed and the magnitude of the deformation. For example, Car-O-Liner in Sweden provides a system called Car-O-Tronic where cars are measured and the measured data are compared with data for the specific car model. The car model data are retrieved from a data base comprising original geometric data for measuring points on thousands of different car models. If the measured data does not comply with the retrieved data, the car is deformed. If the deformation is large the car needs to be aligned.

Methods for aligning vehicles have been provided where portions of the vehicle are supported and a force; large enough to deform the vehicle, is applied to another portion of the vehicle. The supports should be steady enough so that the supported portions do not move during the deforming step.

A problem is that there is a risk that the supports and the supported portions of the vehicle moves when the force is applied, so that the vehicle is not deformed enough.

A subsequent re-measuring of the vehicle will then reveal a remaining deformation, and the vehicle has to be aligned once again.

DISCLOSURE OF INVENTION

The invention provides a method and an arrangement for aligning a vehicle without the drawbacks of the prior art. It provides a method where movements of the supported portions are monitored. The aligning method includes the steps of supporting a first portion of the vehicle, and deforming the vehicle by applying a force to a second portion of the vehicle. The method is characterised by positioning at least one motion sensing measuring unit, comprising at least one accelerometer, on the supported first portion of the vehicle before the deforming step, and tracking any movements of the supported first portion of the vehicle during the deformation by means of the measuring unit. The measuring unit is positioned on a supported portion that is not expected to move, but expected to remain still during deformation.

By tracking movements of a supported portion during the deformation an inadequate deformation can be revealed, and by using an inertial measuring unit the amount of inadequacy can be determined.

Preferably, an inertial measuring unit comprising accelerometers and gyroscopes is used as the motion sensing measuring unit.

In one embodiment, the method includes using an additional motion sensing measuring unit, e.g. an inertial measuring unit, and positioning the second inertial measuring unit on a portion that is expected to move during the deformation, so that the deformation can be monitored.

In a preferred embodiment, the method includes the step of displaying movements of the vehicle during the deformation. In this way the deforming process can be monitored in real-time and it can be ensured that the chassis is deformed as expected and that no unwanted deformation or movement occurs when the force is applied. The monitoring can be provided on a display screen where parts of the chassis that is supposed to move are indicated, and also where parts of the vehicle supposed to remain stationary are indicated in a different way, to the supposedly moving parts, so as to facilitate the control of the process.

The inventive method uses a motion sensing measuring unit comprising at least one accelerometer, preferably two or three. One accelerometer can be used for tracking an unwanted movement, but the use of more than one, and also gyroscopes, provides a more accurate and reliable method. The accelerometer or accelerometers can be combined in the measuring unit with at least one gyroscope, for example, two or three, and thus three accelerometers can be combined with one two or three gyroscopes.

When a motion is detected in a portion of the vehicle that is supposed to remain stationary during the deformation the user can suitable be alerted and the amount of movement, linear distance or angle for example, can be displayed, together also with the acceleration and velocity.

The aligning arrangement comprises at least one support for supporting at least one portion of the vehicle during the deformation and means for applying a force to a second portion to deform the vehicle. The arrangement is characterised in that it comprises means for tracking movements of the first supported portion, including at least one accelerometer, preferably an inertial measuring unit.

MODE(S) FOR CARRYING OUT THE INVENTION

Figure 1:
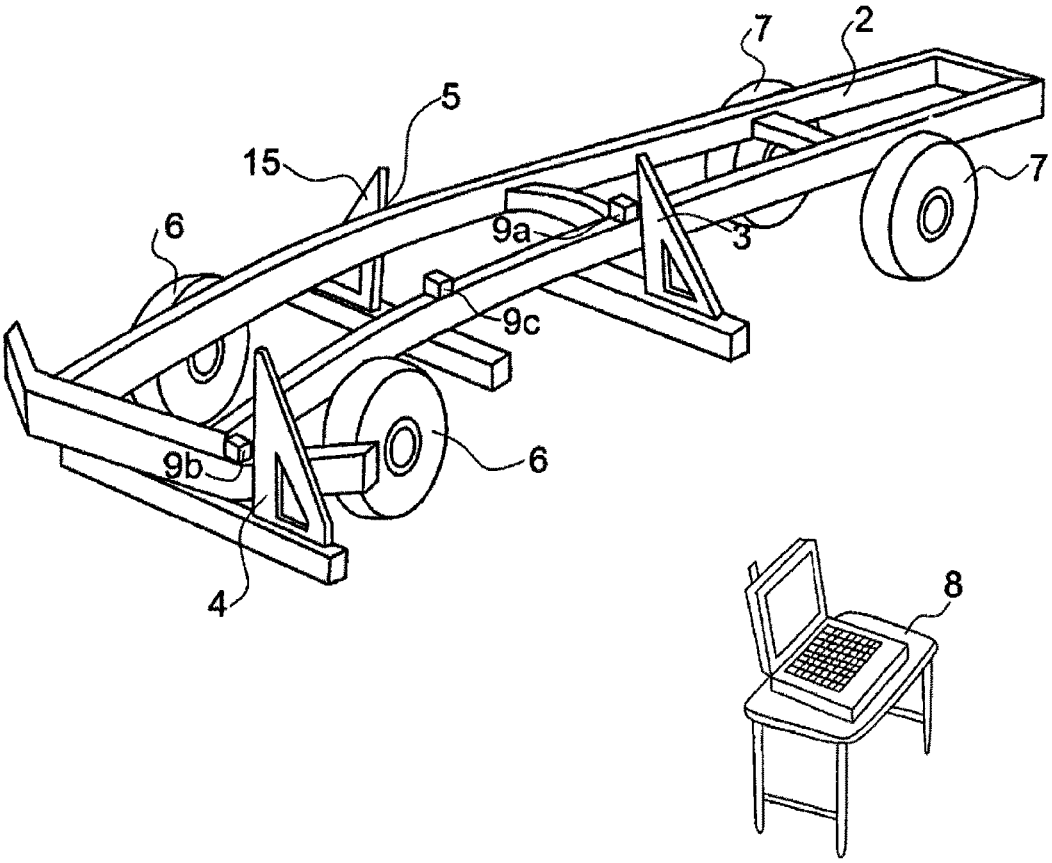
FIG. 1 illustrates an arrangement for aligning a truck; the arrangement supports two portions of the truck and applies a deforming force to one other portion of the truck.

FIG. 1 illustrates an arrangement for aligning a vehicle. It is a simplified illustration of a vehicle, wherein the vehicle is illustrated by its frame 2 and wheels 6, 7. The arrangement includes means 3, 4, 15 for aligning the chassis, such as the frame, of a vehicle including supports 3, 4 and force applying means 15. The arrangement also includes means for tracking movements 8, 9*a-c* comprising inertial measuring units (IMUS) 9*a-c* and a computer 8, wherein the IMUS are communicatively connected to the computer. Each IMU 9*a-c* comprise accelerometers and gyros for sensing its motion, and the movement tracking means 8, 9*a-c* preferably comprise, in a per se known manner, hardware and software for converting the motion data into movements. For example, the acceleration signals from the accelerometers in an IMU 9*a-c*, are converted into distance data, wherein the conversion includes integrating the accelerations twice. The distance data is transferred form each IMU 9*a-c* to the computer 8, which suitably includes a display, by means of which the determined distances can be displayed to a user. Alternatively, the acceleration signals are transferred to the computer 8 and the computer converts them into distance data.

During alignment of a deformed vehicle frame, the frame 2 is supported by the supports 3, 4, which are secured to the floor, and the force applying means 15, e.g. utilising hydraulics, are positioned to provide a force onto a portion of the frame that is deformed. The IMUS 9*a-c* are placed in different positions on the frame 2 and subsequently the force applying means 15 is activated and press the frame 2, held by the supports 3,4, with a sufficiently large force to deform it, and thus aligning it into its original straightness. During this deformation process the IMUS 9*a-c* track the movements, and the computer 8 displays the results. The three IMUS are positioned at different locations on the frame, a first IMU 9*a* is positioned close to the first support 3 and a second IMU 9*b* is positioned close to the second support 4. During alignment of the frame, the supports 3, 4 are supposed to remain immovable and the first and second IMU 9*a*, 9*b* are supposed not to detect any motion. The third IMU 9*c* is, on the other hand, positioned on an unsupported frame segment, and will register a motion during the aligning process.

Figure 3:
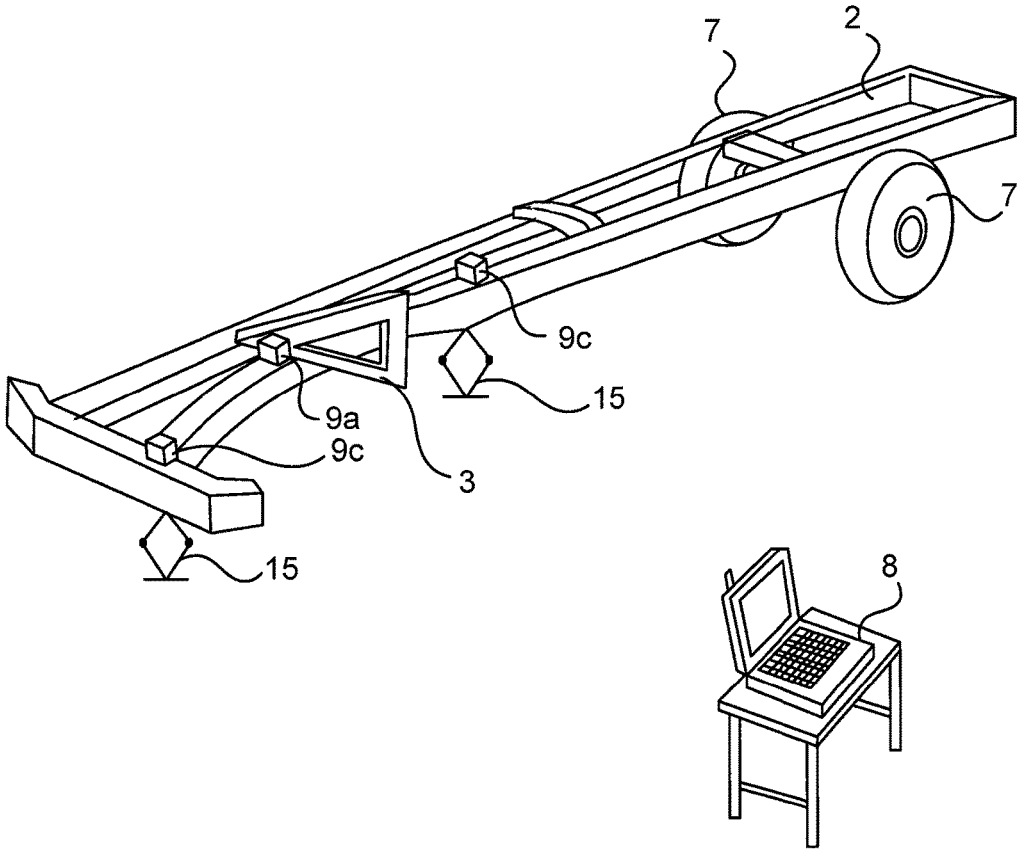
FIG. 3 illustrates an alternative arrangement from above.

In FIG. 1 the frame 2 is straightened by means of two supports 3, 4 and one force applying means pressing the frame sideways. As is known in the art another number of supports and force applying means can be used. Also, other types of deformations can be adjusted. For example, referring to FIG. 3, a vertical deformation of a vehicle, where one section has been deformed upwards, can be adjusted by holding the deformed section down, by means of a single support 3, and lifting upwards on both sides of the deformation, by force applying means 15 in the form of two lifting devices, such as two hydraulic jacks.

Figure 2:
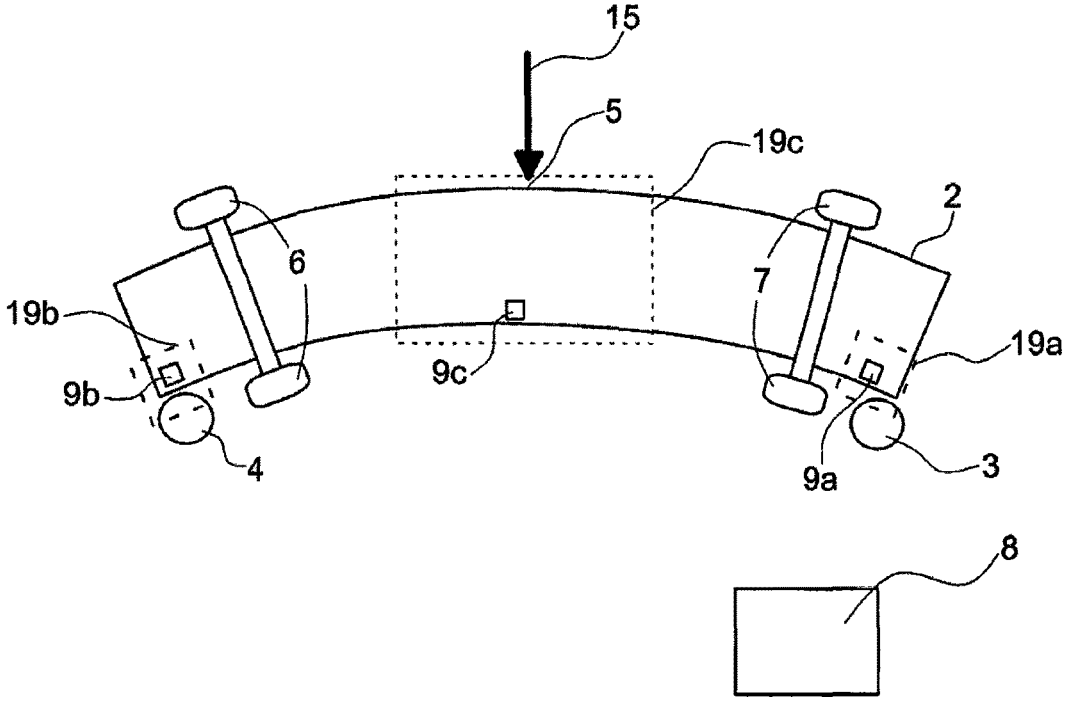
FIG. 2 illustrates a similar arrangement from above.

FIG. 2 illustrates the same kind of deformation and alignment arrangement as in FIG. 1 in a view from above. The vehicle is illustrated by its deformed frame 2 (exaggerated deformation) and front and rear wheels 6 and 7. The frame 2 is supported on its left side by two supports 3, 4 close to the front and rear wheels, respectively. A force is applied in the middle right side of the frame. The movement tracking means include three IMUS communicatively connected to a computer 8.

A first IMU 9*a* is positioned close to one of the supports 3 in section 19*a*, which section should remain still during the deformation. The IMU 9*a* is positioned in a section that should not move or only move very little, so that if a movement occurs, which means that the deforming process is erroneous, this movement, and thus the fault, is detected by the IMU. A second IMU 9*b* is similarly positioned at the other support 4 in another section 19*b* that is not supposed to move, or move very little, during the deformation. If the second support 4 or supported section 19*b* moves, the movement is detected by the second IMU.

A third IMU 9*c*, on the other hand, is positioned within a section 19*c* of the vehicle frame that is distorted or deformed and needs to be aligned. Thus, the third IMU 9*c* is positioned in a section 19*c* that is supposed to move when the deforming force is applied during the deforming process in order to correct its distortion.

Each IMU 9*a-c* communicates with the computer 8, which displays their movements. The computer is adapted to monitor the IMUS 9*a-b* that are positioned in sections that should not move and if they move the computer is adapted to alert an operator by means of an alarm, visual or by sound. The computer can also be adapted to indicate on the display which section has moved, the distance it has moved and the direction. In this way the invention facilitates adjustment of the deformation process when a faulty functioning support is detected. The computer is, in a further embodiment, also adapted to present the movement of the third IMU, which is positioned in an area that should move during the deforming process, on the display for the operator. The computer can suitably be adapted to display an illustration of the chassis and update the illustration during the process, so that an operator can follow the aligning of the frame in this illustration on the display. This gives the operator an enhanced general view of the process and facilitates operation of the force applying means, so that more accurate adjustments can be taken.

The invention claimed is:

1. A method of aligning a vehicle comprising the steps of:

supporting a first portion of the vehicle, deforming the vehicle by applying a force to an unsupported second portion of the vehicle, wherein the supported first portion of the vehicle is to remain stationary during the deforming step, positioning at least one motion sensing measuring unit including at least one accelerometer on the supported first portion of the vehicle before the deforming step, tracking any movements of the supported first portion of the vehicle during the deforming step by means of the motion sensing measuring unit, and determining if the supported first portion of the vehicle remained stationary during the deforming step based on any tracked movements of the supported first portion of the vehicle.

2. A method according to claim 1, further comprising the step of displaying movements of the vehicle during the deforming step.

3. A method according to claim 1, further comprising the step of alarming if the tracked movements are larger than a threshold.

4. A method according to claim 1, including the step of determining a distance of a tracked movement.

5. A method according to claim 1, wherein the motion sensing measuring unit is an inertial measuring unit comprising a plurality of accelerometers and a plurality of gyroscopes.

6. A method according to claim 1, wherein the positioning step includes positioning a second motion sensing measuring unit on an unsupported portion of the vehicle that moves during the deforming step.

7. A method according to claim 1, wherein the step of tracking any movements includes determining a direction of a tracked movement.

8. A method of aligning a vehicle comprising a frame, the method comprising the steps of:

supporting first and second end portions of the vehicle frame, deforming the vehicle frame by applying a force to an unsupported third portion of the vehicle frame that is between the first and second end portions of the vehicle frame, wherein the supported first and second end portions of the vehicle frame are to remain stationary during the deforming step, positioning at least one motion sensing measuring unit including at least one accelerometer on each of the supported first and second end portions of the vehicle frame before the deforming step, tracking any movements of each of the supported first and second end portions of the vehicle frame during the deforming step by means of the at least one motion sensing measuring unit on each of the supported first and second end portions of the vehicle frame, and determining if the supported first and second end portions of the vehicle frame remained stationary during the deforming step based on any tracked movements of each of the supported first and second end portions of the vehicle frame.

9. A method according to claim 8, further comprising the step of displaying movements of the vehicle frame during the deforming step.

10. A method according to claim 8, further comprising the step of alarming if the tracked movements are larger than a threshold.

11. A method according to claim 8, including the step of determining a distance of a tracked movement.

12. A method according to claim 8, wherein each motion sensing measuring unit is an inertial measuring unit comprising a plurality of accelerometers and a plurality of gyroscopes.

13. A method according to claim 8, wherein the positioning step includes positioning a second motion sensing measuring unit on an unsupported portion of the vehicle frame that moves during the deforming step.

14. A method according to claim 8, wherein the step of tracking any movements includes determining a direction of a tracked movement.

15. A method according to claim 8, wherein the tracking step is carried out to determine if the vehicle was deformed a predetermined amount during the deforming step.

* * * * *